United States Patent [19]

Zahn, Jr. et al.

[11] Patent Number: 4,839,632

[45] Date of Patent: Jun. 13, 1989

[54] INTRUSION ALARM SCREEN ASSEMBLY

[76] Inventors: Richard A. Zahn, Jr.; Merle L. Stepp, both of c/o Window Protection Products, Inc., 2576 Stirling Rd., Hollywood, Fla. 33020

[21] Appl. No.: 199,692

[22] Filed: May 27, 1988

Related U.S. Application Data

[63] Continuation-in-part of Ser. No. 71,907, Jul. 10, 1987, abandoned.

[51] Int. Cl.[4] ..... G08B 13/00; H01H 3/16

[52] U.S. Cl. ..... 340/550; 200/61.81

[58] Field of Search ..... 340/550; 200/61.81, 200/61.82, 61.84, 61.93; 109/41; 160/10, 351, 368 R

[56] References Cited

U.S. PATENT DOCUMENTS

| | | | |
|---|---|---|---|
| 484,761 | 10/1892 | Stromberg | 109/41 |
| 2,092,178 | 9/1937 | Murphy | 340/550 X |
| 3,051,935 | 8/1962 | Willson | 340/550 |
| 4,146,293 | 3/1979 | Mutton et al. | 340/550 |
| 4,160,972 | 7/1979 | La Mell et al. | 340/541 |
| 4,232,210 | 11/1980 | Wilson | 340/550 |
| 4,281,320 | 7/1981 | Rosenberg | 340/545 |
| 4,449,121 | 5/1984 | Sosa | 340/550 |
| 4,553,134 | 11/1985 | Holt | 340/550 X |

*Primary Examiner*—Glen R. Swann, III
*Assistant Examiner*—Thomas J. Mullen, Jr.
*Attorney, Agent, or Firm*—Oltman and Flynn

[57] ABSTRACT

An intrusion alarm screen assembly having mounting brackets at the corners and a pair of substantially rigid opposite end piece assemblies on which the screen can be rolled up. At each corner circuit closing means acts between the bracket there and the adjacent end piece assembly to close an alarm circuit through electrical wiring in the screen only when that end piece assembly is held by the bracket.

20 Claims, 8 Drawing Sheets

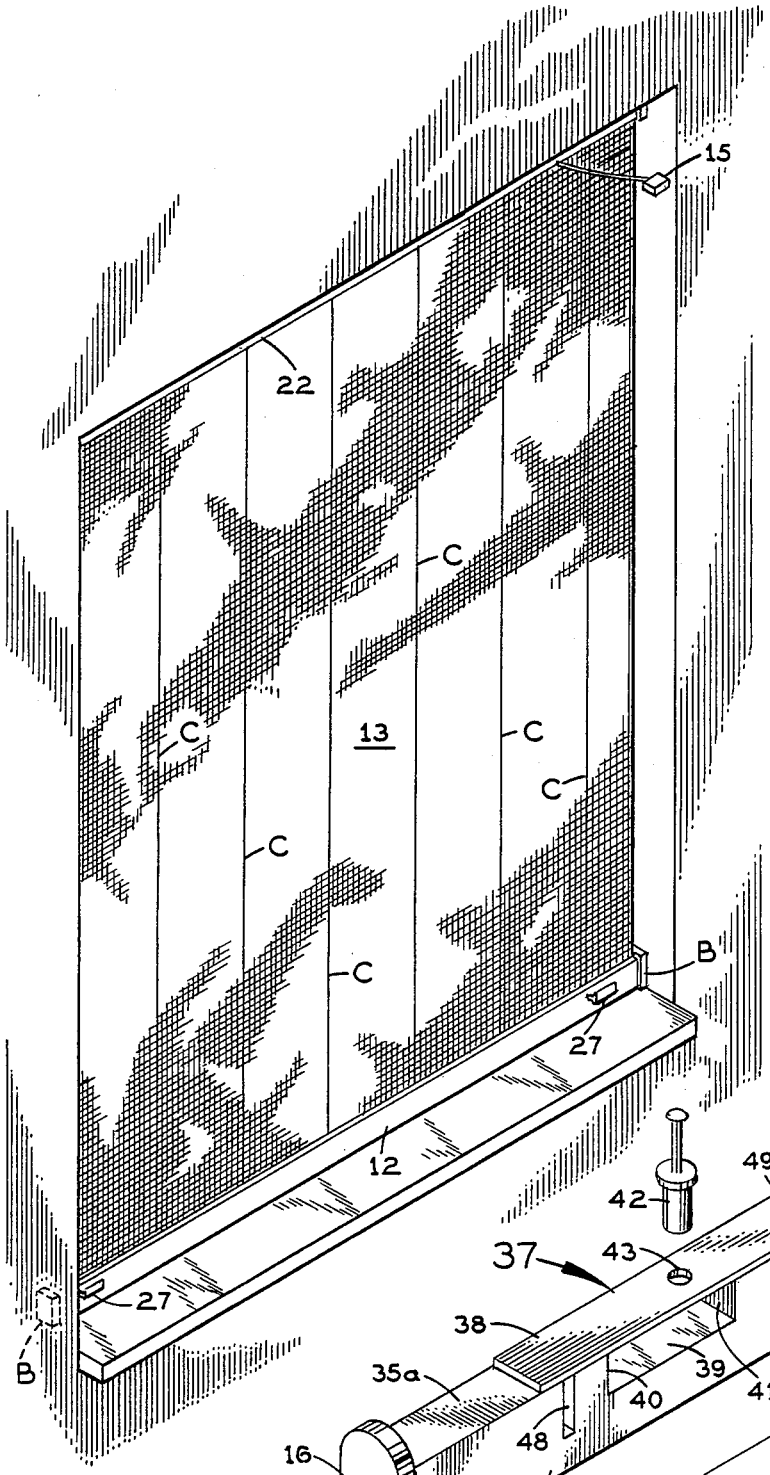
FIG. 3
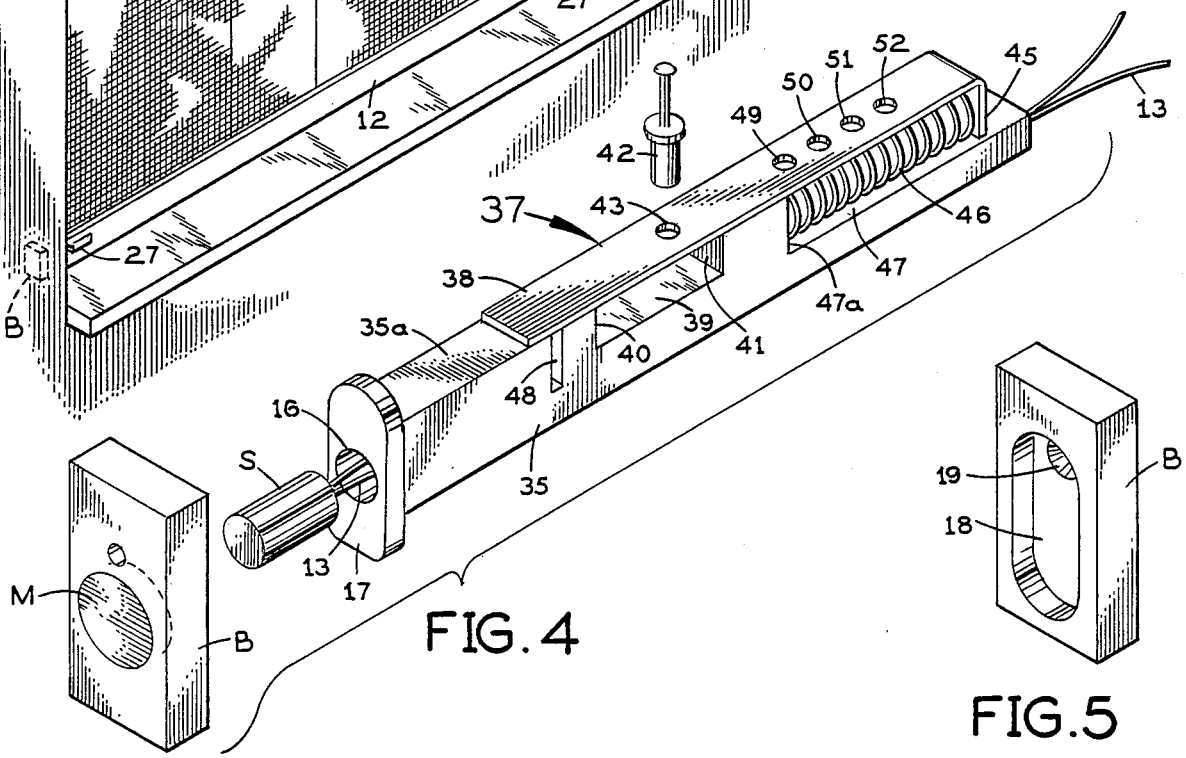
FIG. 4
FIG. 5

FIG. 10
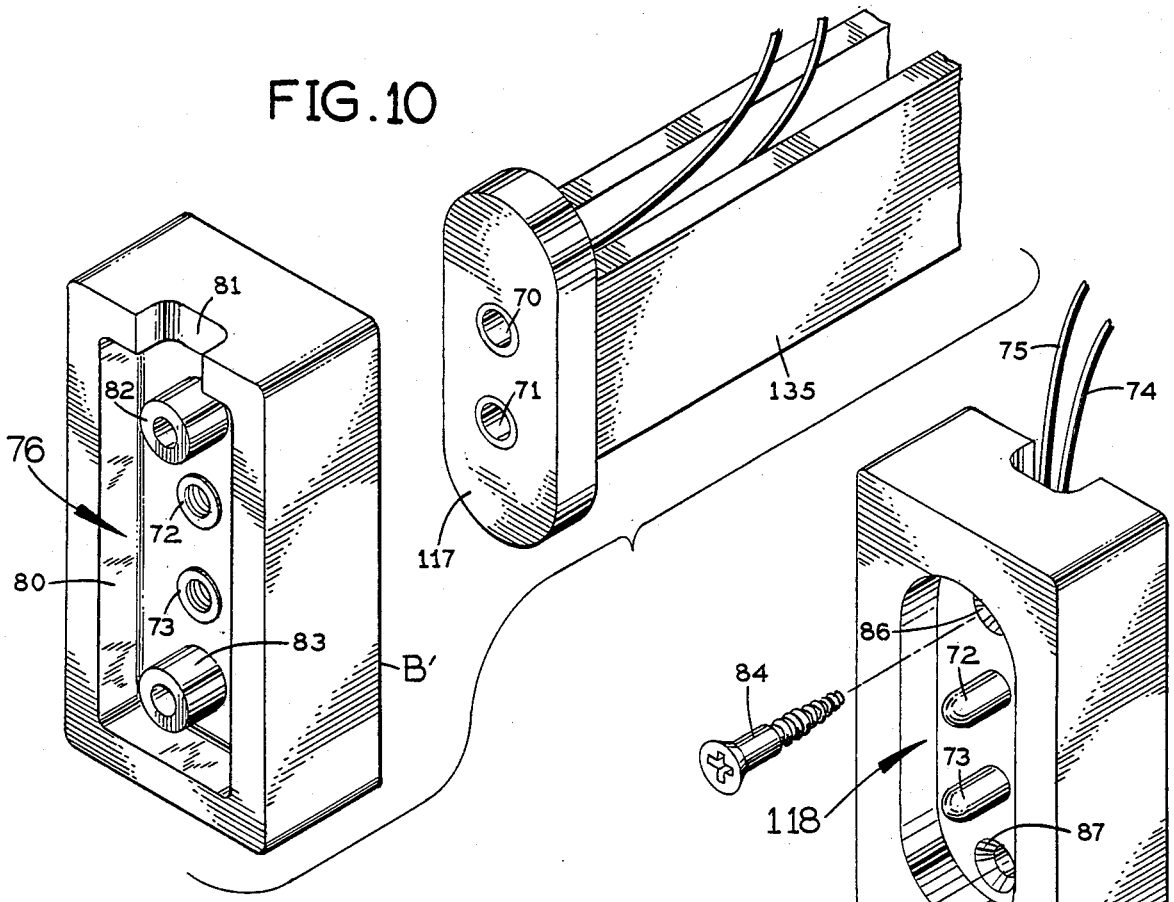
FIG. 11
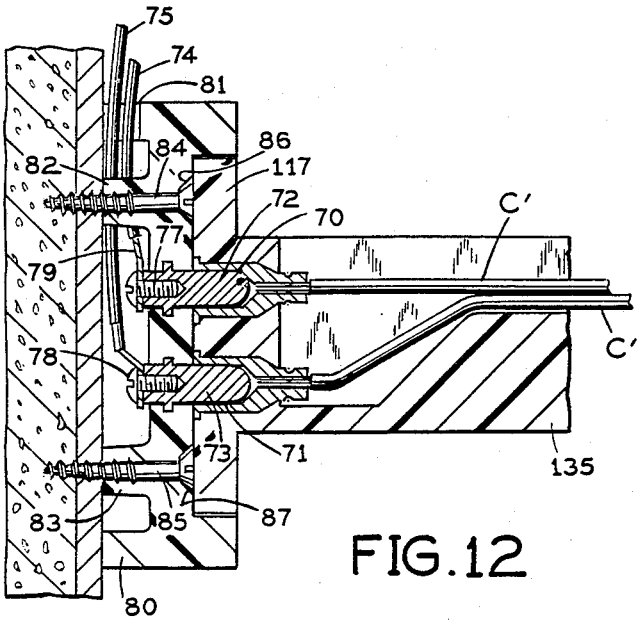
FIG. 12

INTRUSION ALARM SCREEN ASSEMBLY

CROSS-REFERENCE TO RELATED APPLICATION

This application is a continuation-in-part of our copending U.S. Pat. application Ser. No. 07/071,907, filed July 10, 1987, now abandoned.

SUMMARY OF THE INVENTION

This invention relates to an intrusion alarm screen assembly for use at a window or a door to trigger an alarm signal when an intruder attempts to enter.

Present-day intrusion alarm screens have the usual peripheral frame holding a screen on all four sides, the screen itself having electrical wiring which would be broken if the screen were cut open by a burglar. Such screens are relatively costly and troublesome to ship because of the thin, flat, broad surface area shape which makes it vulnerable to accidental damage.

As a practical matter, intrusion alarm screens usually are on the inside of the window to avoid exposure to weathering and tampering from the outside and also to facilitate connecting the screen's electrical wiring in an intrusion alarm system. In addition, a screen on the outside of the window usually is replaced by a storm window during the cold months of the year, and this would mean loss of the intrusion alarm protection at this window as long as the alarm screen is not in place.

Conventional intrusion alarm screens on the inside of a window are inconvenient to remove when the window is to be cleaned or, in the case of horizontally or vertically slidable windows, when the window is to be opened or closed.

The present invention is directed to a novel intrusion alarm screen which permits the occupants of the premises to have easy access to the window and does not interfere with interior window treatments, such as draperies, shades, vertical blinds or Venetian Blinds.

The intrusion alarm screen assembly of the present invention has a pair of substantially rigid end piece assemblies at opposite ends of the screen. The screen is flexible throughout its entire extent between these opposite end piece assemblies. These end piece assemblies are used to mount the screen across a window opening or a doorway providing access into premises to be protected against unauthorized entry. Mounting brackets in the window or doorway opening hold the opposite ends of these end piece assemblies. Electrical circuit closing means in each bracket and the corresponding end of the respective end piece assembly closes a circuit through the wiring in the screen only when the end piece assemblies are in place in the brackets. Therefore, the removal of either end piece assembly from either of its mounting brackets will trigger an alarm signal. Along each edge of the screen between the opposite end piece assemblies there are no electrical switches or terminals which might interfere with, or be subject to damage by, rolling up the screen around either of the end piece assemblies as a core.

Preferably, the circuit closing means are permanent magnets on the brackets and magnetically-operated, normally-open reed switches located in the opposite ends of each end piece assembly. The magnet keeps the reed switch closed only as long as the end piece assembly is seated in the bracket.

Preferably also, each end piece assembly of the screen has interchangeable switch carriers at its opposite ends, one of which has a fixed position and the other of which is spring-biased outward for snap-in insertion into a corresponding mounting bracket. Interchangeable retainer members hold the switch carriers on the end piece assembly, one holding its switch carrier in a fixed position and the other holding its switch carrier spring-biased.

Alternatively, the magnets and reed switches may be replaced by electrical plug and socket connectors on the mounting brackets and the corresponding ends of the screen's end piece assemblies so that the alarm circuit through the wiring in the screen is opened whenever either end piece assembly is removed from either bracket which normally supports it.

A principal object of this invention is to provide a novel roll-up intrusion alarm screen assembly.

Another object of this invention is to provide a screen assembly which can be rolled up without any substantial danger of damaging any of its electrical components.

Another object of this invention is to provide such a screen assembly having a novel arrangement of interchangeable parts which are used in different ways in different parts of the screen assembly.

Further objects and advantages of this invention will be apparent from the following detailed description of three embodiments which are illustrated in the accompanying drawings.

DESCRIPTION OF THE DRAWINGS

FIG. 3 is a perspective view of this screen assembly in place at the inside of a window;

FIG. 4 is an exploded perspective view showing one of the mounting brackets and one of the spring-biased switch carriers and the retainer member holding it in one of the end piece assemblies in this screen assembly;

FIG. 5 is a front perspective view of one of the mounting brackets;

FIG. 10 is an exploded perspective view of a mounting bracket and the part of the end piece assembly which fits in it, in accordance with a second embodiment of this invention;

FIG. 11 is a perspective view of the opposite side of the mounting bracket in FIG. 10;

FIG. 12 is a vertical longitudinal section through the assembly of the bracket and the corresponding end piece assembly in this second embodiment of the invention;

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Figure 1:
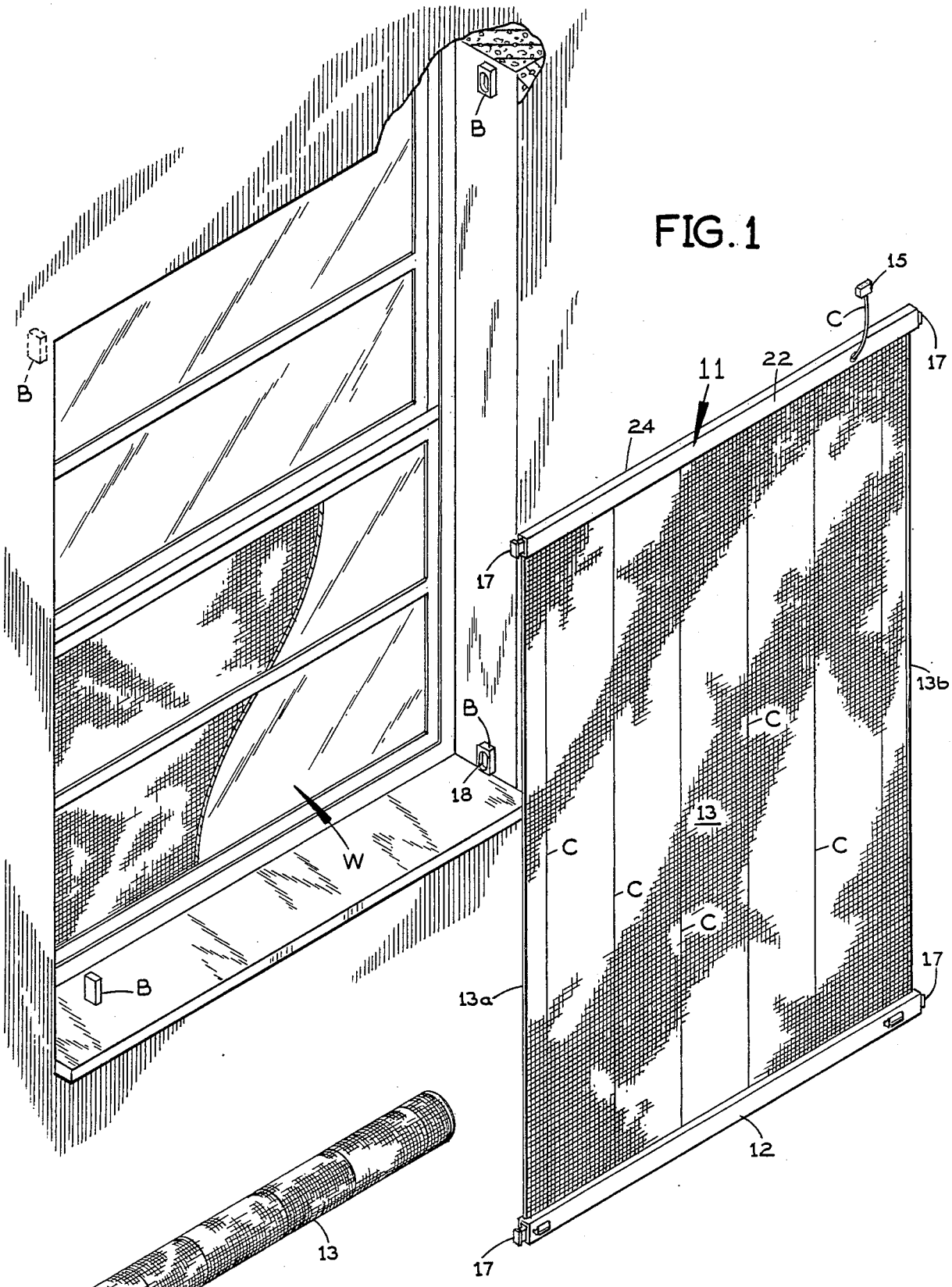
FIG. 1 is an exploded perspective view of a first embodiment of the present intrusion alarm screen assembly at the inside of a window.
Figure 2:
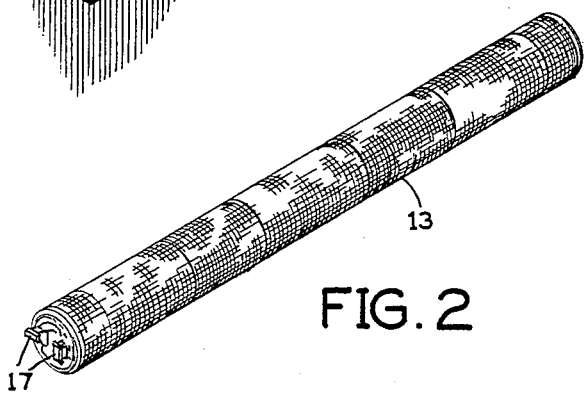
FIG. 2 shows the screen rolled up for shipping or storage.
Figure 9:
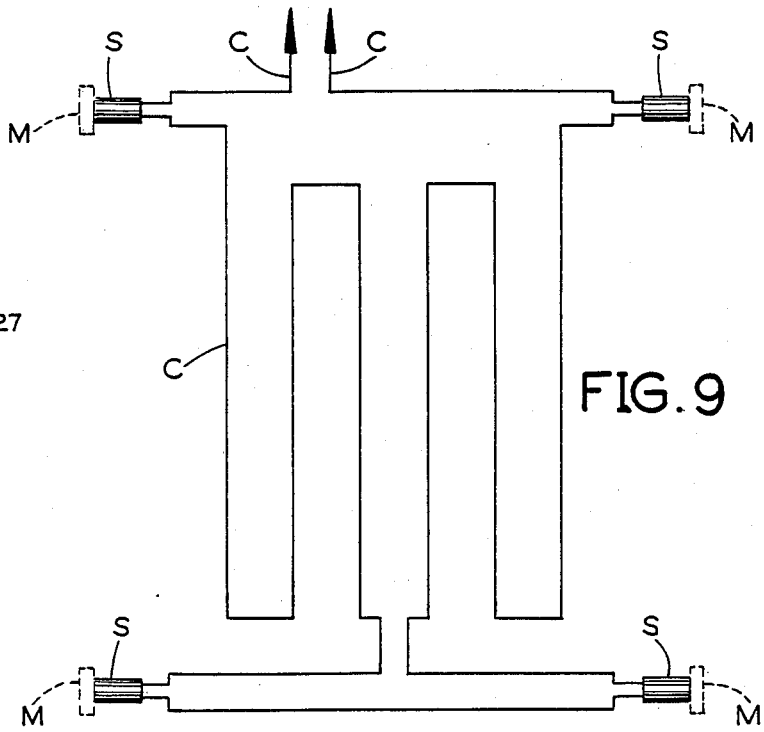
FIG. 9 is a schematic electrical circuit diagram showing the electrical conductor in the screen and the reed switches at the four corners of the screen in this first embodiment of the invention.

Referring to FIG. 1, in broad outline the present screen assembly has four mounting brackets B mounted on the wall of a building at the four corners of a rectangular opening closed by a window W. The window may have horizontally pivoted louvers or it may be a sash window that slides up and down or sideways. The screen assembly has relatively rigid end piece assemblies at opposite ends, here shown as a top piece assembly 11 and a similar bottom piece assembly 12. A flexible screen 13 extends between the top and bottom piece assemblies and includes an insulated electrical conductor C which is connected in an intrusion alarm system of known design, the details of which are not part of the present invention. As shown in FIG. 2, because it has no rigid side pieces between its top and bottom end piece assemblies 11 and 12, the screen 13 may be rolled up in a tight roll for convenient shipping or storage. As shown in FIG. 1, the screen presents continuous, straight, uninterrupted opposite edges 13*a* and 13*b* with no projecting elements, such as electrical terminals, which might interfere with, or be damaged by, the rolling up of the screen to the compact shape shown in FIG. 2. Preferably, the electrical conductor C includes long segments which replace vertical strands of the screen and are spaced apart in succession horizontally a few inches. As shown schematically in FIG. 9, these vertical electrical wires are interconnected at the top and bottom of the screen in series with each other and in series with four normally-open electrical switches S across the electrical terminals of an electrical connector 15 of known design for connection in an intrusion alarm circuit.

With this arrangement, an alarm signal is produced if the electrical wiring C in the screen is broken at any point along its length or if any of the switches S opens.

Each switch S is a magnetically-operated reed switch and, as shown in FIG. 4, each reed switch S is encased in a cylindrical housing which fits snugly inside a complementary recess 16 in one end of either the top piece assembly 11 or the bottom piece assembly 12 of the screen. Each reed switch S is a normally-open switch which is closed when in close proximity to a permanent magnet.

Figure 6:
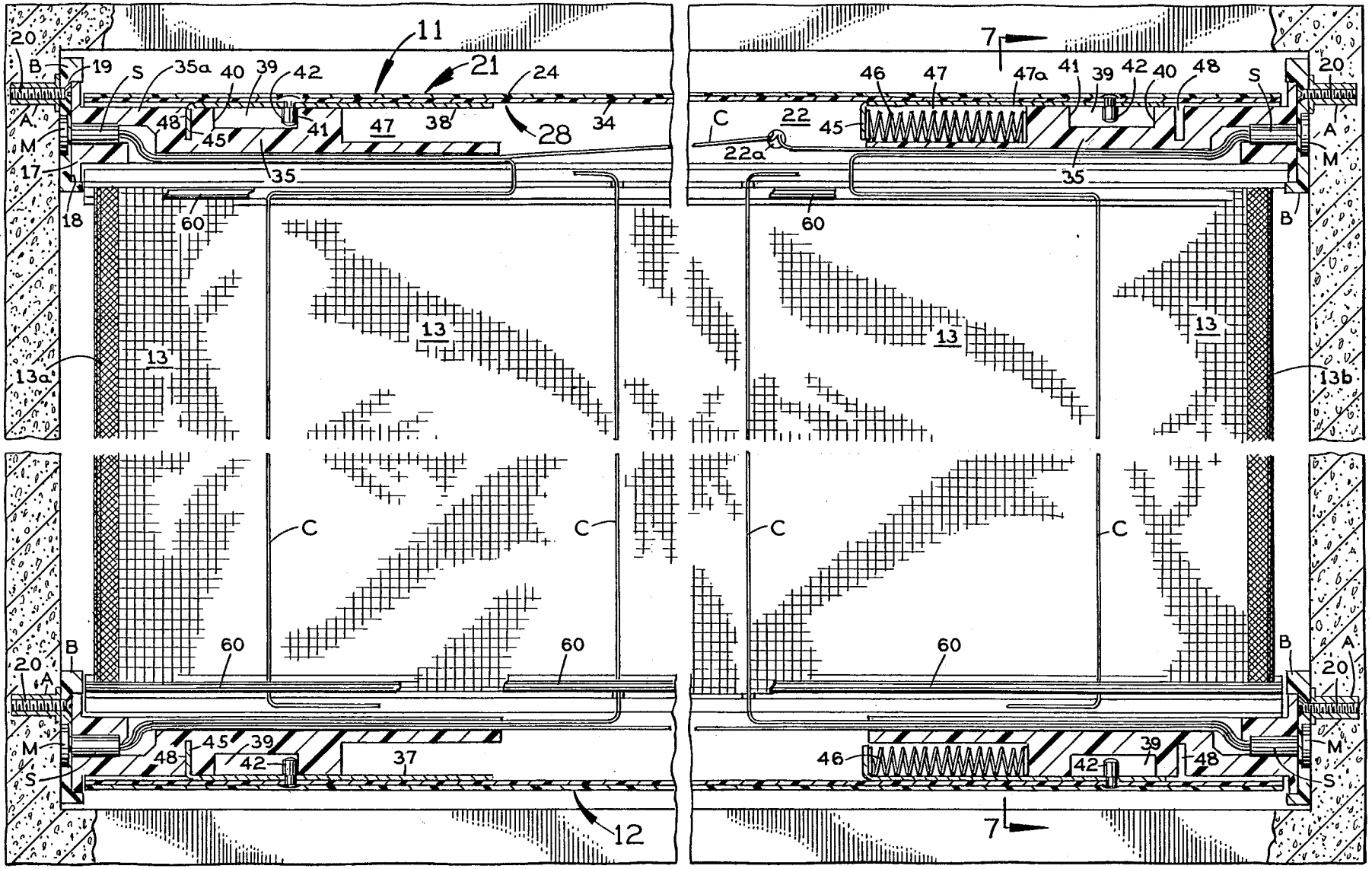
FIG. 6 is an elevational view of this screen assembly installed over a window and with certain parts broken away for clarity.

As shown in FIG. 4, the top piece assembly 11 of the screen has an oblong rectangular end segment 17 with rounded corners which fits snugly but slidably in a recess 18 (FIG. 5) in the corresponding mounting bracket B. This recess faces laterally inward when the mounting bracket is mounted in place at the building opening where the window is located. The mounting bracket holds a permanent magnet M which keep the reed switch S closed when the end segment 17 of the top piece assembly 11 of the screen is seated in the mounting bracket recess 18. FIG. 6 shows the top piece assembly of the screen with its oblong end segment 17 seated in recess 18 of the corresponding mounting bracket B and with the corresponding reed switch S in close proximity to the magnet M on that mounting bracket. Whenever this end segment 17 of the top piece assembly is removed from the mounting bracket B, the reed switch S opens automatically.

As shown in FIG. 6, the mounting bracket recess 18 snugly but slidably receives the end segment 17 of the top piece assembly 11 of the screen. The mounting bracket presents an opening 19 near the top of its recess 18. On the inner side of the bracket this opening provides a frusto-conical seat for the head of a mounting screw 20, which fastens the mounting bracket to the wall of the building at the window opening. For example, if the building is of concrete block construction, the screw-threaded shank of mounting screw 20 may be received in a plastic or lead wall anchor A in the building wall on that side of the window opening.

The same mounting arrangement is provided at each of the four corners of the screen. At each end, the top or bottom piece assembly 11 or 12 of the screen has an enlarged end segment 17 which fits snugly but slidably in the recess 18 on the corresponding mounting bracket B and positions the corresponding reed switch S to be kept closed by the permanent magnet M on that bracket as long as that end segment of the top or bottom piece assembly of the screen is received in the bracket.

The top and bottom piece assemblies 11 and 12 of the screen are mirror images of one another. For almost its entire length between the mounting brackets B on opposite sides of the window opening, the top or bottom piece assembly has a rigid end rail (FIG. 7) composed of an outer piece 21 and an inner piece 28 which fits inside the outer piece.

Figure 8:
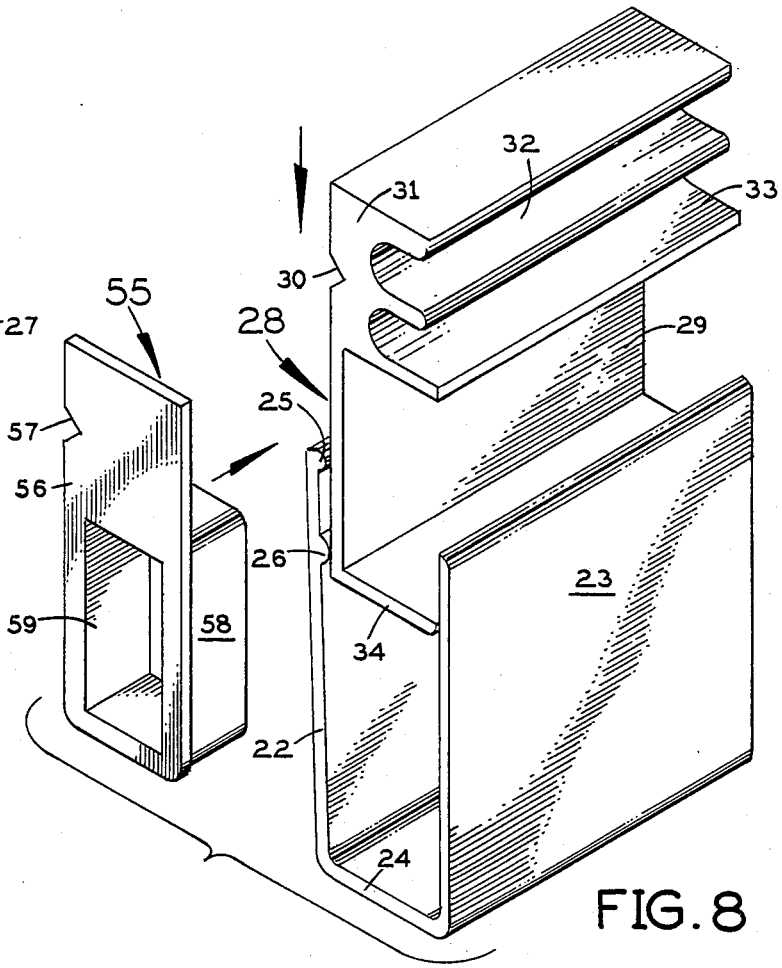
FIG. 8 is a fragmentary exploded perspective view of the outer channel and the inner piece of the end rail in either end piece assembly in the screen.

As shown in FIG. 8, the outer piece 21 is a channel having a vertical front wall 22, a vertical back wall 23, and a horizontal end wall 24 bridging the front and back walls. This bridging wall 24 is the top wall of the outer channel 21 of the top end rail of the screen and it is the bottom wall of the outer channel of the bottom end rail of the screen. The front wall 22 of channel 21 is formed on its inner (rear) side with a rounded bead 25 along its free edge away from bridging wall 24 and a similar bead 26 parallel to bead 25. One or more handles 27 (FIG. 8) extend out from the front wall at intervals along the length of channel 21.

The inner piece 28 of each top or bottom end rail is an extruded body that fits snugly inside the outer channel 21 with a snap-in fit. This inner piece has a vertical front wall 29 (FIG. 8) with a V-groove 30 on the front for receiving the bead 26 on the front wall 22 of the outer channel 21. Behind this groove and above and below it the inner piece 28 has an end segment 31 of substantial vertical thickness which presents a pair of rearwardly-facing, horizontal, parallel grooves or recesses 32 and 33.

Figure 7:
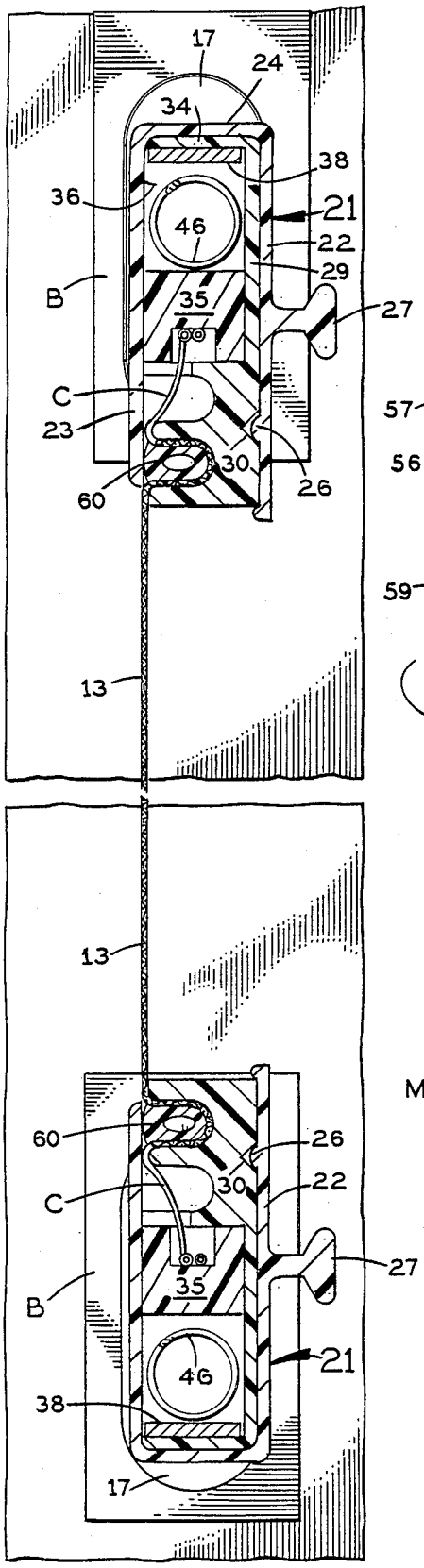
FIG. 7 is a vertical cross-section taken along the line 7—7 in FIG. 6.

As shown in FIG. 7, groove 32 receives the screen 13 along its adjacent (top or bottom) edge. A removable elongated spline 60 of rubber-like material holds the screen 13 wedged in the groove 32 on the inner piece 28 of the top or bottom end rail.

The inner piece 28 has a relatively thin flat segment 34 (FIG. 8) at its opposite end from the grooved end segment 31. End segment 34 of inner piece 28 fits against the inside of the bridging end wall 24 of the outer channel 21, as shown in FIG. 7, when the bead 26 on the outer channel 21 fits in the groove 30 on the inner piece 28. In this assembled position of the parts, the other bead 25 on the outer channel 21 engages the outside of end segment 31 of the inner piece 28, and both end segments 31 and 34 of the inner piece 28 have a snug fit inside the outer channel 21 of the respective top or bottom end piece.

At each end, each end piece assembly 11 or 12 has a carrier for the corresponding reed switch S. On one side of the screen (the left side in FIG. 6) the switch carrier has a fixed position laterally of the screen. On the opposite side of the screen (the right side in FIG. 6) the switch carrier is spring-biased laterally outward to resiliently hold the reed switch it carries against the corresponding magnet M.

As shown in FIG. 4, the switch carrier is a rigid horizontally elongated body 35 of rectangular cross-section to which the previously-mentioned enlarged end segment 17 is attached. As shown in FIG. 7, when the outer channel 21 and the inner piece 28 of the top or bottom end rail are assembled, they define a horizontally elongated recess 36 between the back wall 23 of the outer channel and the front wall 29 and the opposite end segments 31 and 34 of the inner piece 28. A respective switch carrier 35 is slidably received in this recess at each end of the end rail made up of outer channel 21 and inner piece 28.

As shown in FIG. 4, a right-angled, generally L-shaped retainer member 37 for the switch carrier 35 has a flat, elongated, horizontal leg 38 which overlies the switch carrier 35 in the top end rail of the screen assembly. In the bottom end rail of the screen assembly, the leg 38 of retainer member 37 extends beneath the corresponding switch carrier 35. Thus, in each end piece assembly 11 or 12 the switch carrier is between the corresponding retainer member and the screen. At one end the retainer member 37 presents a short transverse end leg 45. FIG. 4 shows the position of retainer member 37 with respect to the switch carrier 35 at the right side of the screen in FIG. 6 but viewed from the window side of the screen. Here the switch carrier is spring-biased laterally outward along the end rail 21,28. At the left side of the screen, the retainer member 37 has the same orientation with respect to the end rail 21,28 but the reverse position with respect to the switch carrier 35 there. It holds the switch carrier in a fixed position along the end rail 21,28, as explained hereinafter.

At its inner end the switch carrier 35 presents a longitudinally extending recess 47 (FIG. 4) which is open along the face 35*a* of the switch carrier next to the long leg 38 of retainer member 37. Recess 47 is open at the inner end of the switch carrier 35 and its ends at a transverse end face 47*a*.

Toward its outer end the switch carrier presents a narrow slot 48, which also is open at the face 35*a* of the switch carrier next to the long leg 38 of retainer member 37.

Between the inner end recess 47 and the narrow slot 48 the switch carrier presents an additional longitudinal recess 39, which also is open at the face 35*a* of the switch carrier next to the long leg of retainer member 37. Recess 39 has a transverse outer end face 40 and a transverse inner end face 41.

At the location of each switch carrier 35 in the end piece assembly a corresponding stop pin 42 is riveted to the inner piece 28 of the end rail. The stop pin 42 projects toward the switch carrier 35. The stop pin 42 can project snugly but slidably through any of several openings 43,49,50,51 and 52 in the long leg 38 of the L-shaped retainer member 37. In one practical embodiment, the openings 49,50,51 and 52 are closely spaced in succession along this edge of the retainer while opening 43 is relatively far from the next opening 49.

When retainer member 37 is reversed from the position with respect to switch carrier 35 shown in FIG. 4 and its transverse end leg 45 is received in the narrow slot 48 in switch carrier 35, all of the closely spaced openings 49–52 in the retainer member register with the recess 39 in the switch carrier, with opening 49 next to the shoulder 41 at one end of the recess and opening 52 next to opposite end shoulder 40 of the recess.

At the right side of the screen in FIG. 6, this transverse leg 45 of retainer member 37 is at its laterally inward end, and a coil spring 46 is engaged under compression between this leg and the transverse shoulder 47*a* of the end recess 47 in the switch carrier 35. In this arrangement, the spring 46 biases the switch carrier 35 laterally outward with respect to the retainer member 37 and the inner piece 28 of the end rail, which are fixedly positioned laterally of the screen. The stop pin 42 carried by the inner piece 28 of the end rail projects into recess 39 in switch carrier 35. The laterally outward movement of switch carrier 35 is limited by the engagement of its stop shoulder 41 against stop pin 42. Its laterally inward movement (against the force of its spring 46) is limited by the engagement of its other stop shoulder 40 with stop pin 42. In a typical installation on a window, the lateral position of switch carrier 35 is such that stop pin 42 is about midway between its stop shoulders 40 and 41.

On the left side of the screen in FIG. 6 each retainer member 37 is reversed with respect to the corresponding switch carrier 35 and it holds that switch carrier in a fixed position laterally of the screen. Here the short transverse end leg 45 of retainer member 37 is snugly received in the narrow slot 48 in switch carrier 35. One of the closely spaced openings 49,50,51 or 52 passes the stop pin 42 which is riveted to the inner member 28 of the end rail, depending upon the width of the window opening in the building. The stop pin 42 projects into the longitudinal recess 39 in switch carrier 35 at a location which depends upon which one of the closely spaced openings 49–52 in the retainer member receives the stop pin. In FIG. 6 at the left side of the screen, stop pin 42 passes through the opening 49 farthest from the transverse end leg 45 of the retainer member and it is next to the end shoulder 41 of recess 39 in the switch carrier. The spring 46 is not used here. In this position of the parts, the retainer member 37 holds the switch carrier 35 in a fixed lateral position in which its outer end segment 17 is just beyond the adjacent left end of the outer channel 21 and the inner piece 28 of the end rail.

As shown in FIGS. 1 and 6, the front wall 22 of the outer channel 21 of the top end rail has an opening 22*a* through which the electrical wires C extend out to the electrical connector 15, which is located on the inside of the building for connection in a burglar alarm system (not shown).

As shown in FIG. 6, inside the top end rail the electrical wires C extend laterally outward beneath the switch carriers 35 to the respective reed switches S. Each switch S is seated in a corresponding recess 16 extending through the enlarged end segment 17 and into the body of the switch carrier 35 laterally inward from that end segment.

At the lower end rail in FIG. 6, the electrical wires C extend down from the screen 13 near the middle of the screen from left-to-right and then these wires extend laterally out above the respective switch carriers 35 to the corresponding reed switches S.

FIG. 8 shows an optional end cap 55 for attachment to each end of the inner piece 28 each end rail. This end cap has a flat vertical outer wall 56 with a V-groove 57 along one side edge for registration with the groove 30 in the corresponding inner piece 28. Wall 56 extends completely across the end segment 31 of inner piece 28 and covers the adjacent end of grooves 32 and 33 in that segment. Joined to the outer wall 56 of the end cap is a laterally inwardly projecting collar 58 of generally rectangular outline which is snugly received between the front wall 29 and the end segments 31 and 34 of the inner piece 28 and the back wall 23 of the outer channel 21 of the top or bottom end rail. A rectangular opening 59 extends through the end cap at this collar and slidably receives the switch carrier 35.

This end cap 55 may be omitted, and the other Figures of the drawing show it omitted from the top and bottom end rails.

OPERATION

In the use of this screen assembly, the laterally-fixed end members 17 on the top and bottom piece assemblies 11 and 12 of the screen may be inserted into the corresponding mounting brackets B to position the respective reed switches S in close proximity to the magnets M on those brackets. The switch carriers 35 on the right side are pushed in against the outward force exerted by the respective springs 46 to enable them to be inserted into the brackets B on that side of the window, and then the person installing the screen releases these switch carriers so that the respective springs 46 can push them laterally outward and position the corresponding reed switches S in close proximity to the respective M magnets on the brackets. In this position, all four magnets M hold the respective reed switches S closed.

If an intruder starts to remove the screen, as soon as any one of the reed switches on any corner of the screen is moved away from the bracket-mounted magnet M which has been keeping it closed, that switch opens automatically and actuates the intrusion alarm circuit.

The same alarm condition occurs if an intruder cuts the screen enough to break the electrical conductor C anywhere along its entire length, or if the intruder disconnects the electrical connector 15 from the alarm circuit.

Thus, the screen protects the premises against unauthorized entry at that window, whether the entry is attempted by removal of the screen assembly or by cutting it open enough for the intruder to enter.

That the screen assembly can be rolled up, as shown in FIG. 2, for shipment or storage is a great practical advantage because the screen can be shipped in a compact condition safely in a tube and removed from the tube with minimum risk of damage.

Even more important, the screen can be readily rolled up to the top to permit the window to be opened or closed or to be cleaned. This is particularly advantageous on sliding windows, whether vertically or horizontally slidable between closed and open positions.

If desired, the end piece assemblies 11 and 12, instead of being at the top and bottom of the screen, could extend vertically along the opposite sides of the screen, leaving the top and bottom edges of the screen without an end piece assembly. That would preserve the roll-up adaptibility of the screen. In such an embodiment, the mounting brackets would, of course, be mounted in the top and bottom walls of the window opening to receive the end piece assemblies.

If desired, both switch carriers 35 on each end piece assembly 11 or 12 can be spring-biased laterally outward instead of one of these switch carriers being fixedly positioned along that end piece assembly.

FIGS. 10–12 show an alternative arrangement in which the magnet M and reed switch S combination at each corner of the screen assembly is replaced by an electrical plug-and-socket combination which is, in effect, a manual switch for closing the electrical circuit when the plug is in the socket and opening the circuit when they are apart. Elements in FIGS. 10–12 which correspond to those in FIGS. 1–9 are given the same reference numerals plus 100, so the detailed description of these elements need not be repeated.

As shown in FIG. 11, the mounting bracket B′ has an oblong recess 118 on its laterally inward side for snugly receiving a complementary end segment 117 (FIG. 10) on one end of the end piece assembly. End segment 117 holds an electrical socket having two generally tubular metal receptacles 70 and 71. Bracket B′ holds an electrical plug having two prongs 72 and 73 for reception respectively in the socket receptacles 70 and 71, as shown in FIG. 12. The socket receptacles 70 and 71 on the end piece assembly 111 are connected to different segments of the electric wiring C′ in the screen. The plug prongs 72 and 73 are connected to insulated wires 74 and 75, respectively, in the burglar alarm circuit (not shown) for the building premises which is wired so that if the plug-and-socket connection is broken at any of the four corners of the screen, the alarm circuit will produce an alarm signal.

The body member 135 which carriers the end segment 117 may be spring-loaded at one end only or at both ends of the end piece assembly of which it is a part, as already described with reference to the embodiment of FIGS. 1–9.

As shown in FIG. 10, at its laterally outward side each mounting bracket B′ has a generally rectangular recess 76 at which the back ends of the prongs 72 and 73 are exposed. Each prong has a screw-threaded recess 77 in its back end for receiving a corresponding screw 78 which attaches the corresponding terminal 79 of the alarm circuit wiring 74 or 75 to the respective prong. The bracket B′ presents a marginal wall 80 surrounding its recess 76. A slot 81 is formed in the top segment of this marginal wall for passing the alarm circuit wires 74 and 75, as shown in FIG. 12.

At 76 the bracket B′ presents a pair of annular bosses 82 and 83 for passing mounting screws 84 and 85, respectively. At its recess 118 on its laterally inward side the bracket presents frusto-conical recesses 86 and 87 which lead into the openings through bosses 82 and 83. These recesses provide seats for the tapered heads of the mounting screws 84 and 85.

FIG. 12 shows the assembled position of these parts at one of the four corners of the screen. The end segment 117 of the screen's end piece assembly 111 fits snugly in the bracket recess 118, covering the heads of the mounting screws 84 and 85. The socket receptacles 70 and 71 on end segment 117 receive the electrical plug prongs 72 and 73, completing the electrical circuit between the screen wiring C and the burglar alarm circuit at this corner of the screen.

FIGS. 13–17 show a third embodiment of the present invention, which is the preferred embodiment. Elements of this third embodiment which correspond to elements of the first embodiment are given the same reference numerals, plus 200, as those of the first embodiment. In the third embodiment, each mounting bracket has the reference character B″, each magnetically-operated reed switch has the reference character S″, and the magnet on each mounting bracket has the reference character M′.

The top and bottom end piece assemblies 211 and 212 of this intrusion screen assembly are mirror images of one another. For almost its entire length between the mounting brackets B″ on opposite sides of the window opening, the top or bottom piece assembly has a rigid end rail (FIG. 14) composed of an outer piece 221 and an inner piece 228 which fits inside the outer piece.

Figure 14:
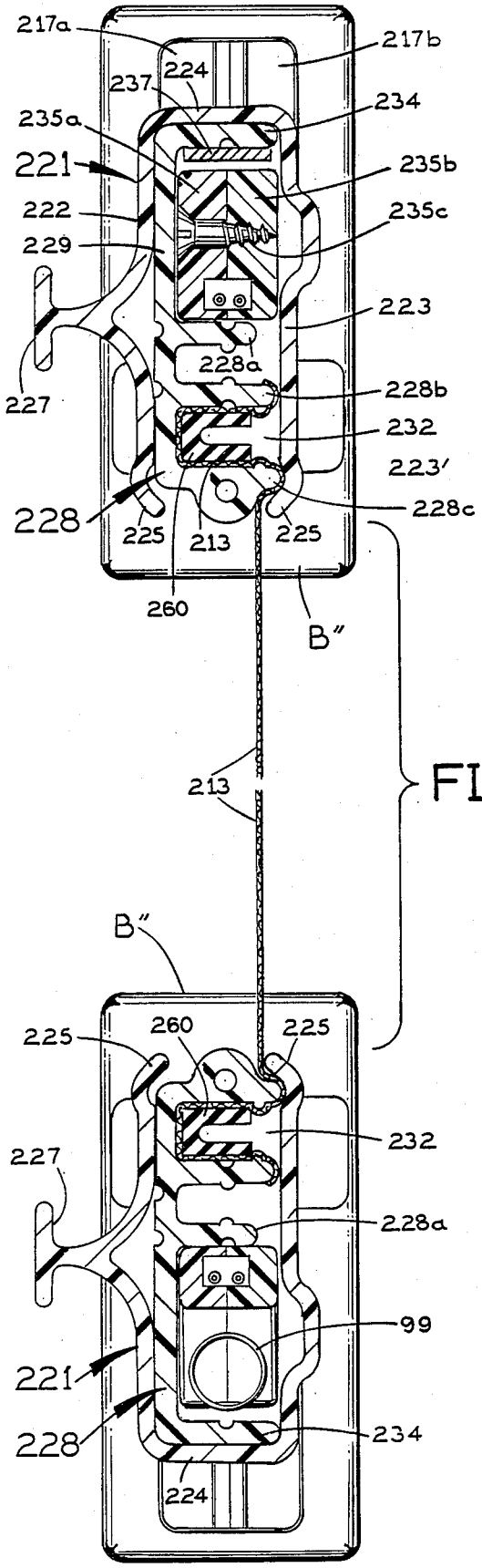
FIG. 14 is a vertical cross-section taken along the line 14—14 in FIG. 13.
Figure 15:
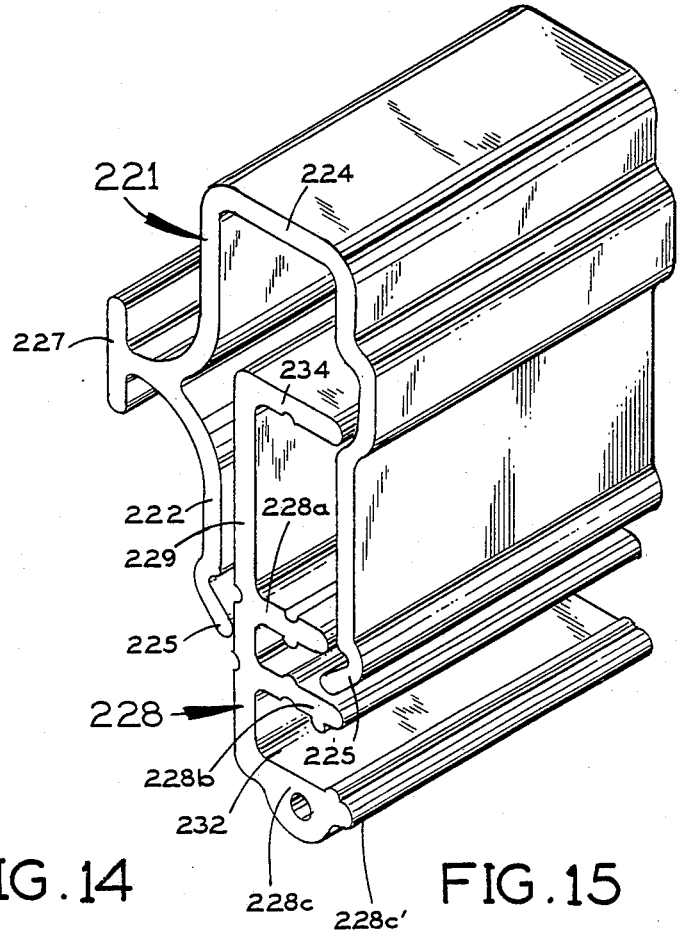
FIG. 15 is a view similar to FIG. 8 and showing one of the end rails in the third embodiment.

As shown in FIG. 14, the outer piece 221 is an extruded channel having a generally vertical front wall 222, a generally vertical back wall 223, and a horizontal end wall 224 bridging the front and back walls. This bridging wall 224 is the top wall of the outer channel 221 of the top end rail of the screen and it is the bottom wall of the outer channel of the bottom end rail of the screen. The front wall 222 of outer channel 221 is formed on its inner (rear) side with an inwardly inclined lip 225 along its free edge away from bridging wall 224. One or more handles 227 extend out from the front wall at intervals along the length of outer channel 221. The back wall 223 of outer channel 221 has an inwardly inclined lip **225*a* along its free edge away from bridging wall 224 and an internal rounded groove 223′** inside this lip.

The inner piece 228 of each top or bottom end rail is an extruded body that fits snugly inside the outer channel 221 with a snap-in fit. This inner piece has a vertical front wall 229, a transverse end segment 234 which extends perpendicularly behind the front wall and fits next to the end wall 224 of outer channel 221, a second transverse segment **228*a* extending parallel to segment 234 about mid-way along the vertical extent of front wall 229, a third transverse segment 229*a* extending parallel to segment 228*a* and closely spaced from it on the opposite side of it from the end segment 234, and a transverse opposite end segment 228*c* extending parallel to segment 228*b*. End segment 228*c* has a rounded back edge 228*c*′. Between its transverse segments 228*b* and 228*c*, the inner piece 228 of the end rail presents a rearwardly-facing, horizontal recess 232 which receives the screen 213 along its adjacent (top or bottom) edge. A removable elongated spline 260 of rubber-like material holds the screen wedged in this groove 232**.

When the outer and inner pieces 221 and 228 are assembled, as shown in FIG. 14, the front wall 229 of the inner piece engages the inside face of the front wall 222 of the outer piece, the end segment 234 of the inner piece is next to the bridging wall 224 of the outer piece, and the groove 223′ on the back wall 223 of the outer piece receives the rounded back edge **228*c*′ of end segment 228*c* on the inner piece. The screen extends from behind the spline 260 in recess 232 in the inner piece, between the edge 228*c*′ on the inner piece and the groove 223′** in the outer piece.

The end rail defines a longitudinal recess of approximately rectangular cross-section which is defined by the end segment 234, the front wall 229 and the first segment **228*a* of its inner piece 228 and part of the back wall 223 of its outer piece 221**. This recess is open at each end of the end rail.

At each end, each end piece assembly 211 or 212 has a carrier for the corresponding reed switch S″. On one side of the screen (the left side in FIG. 13) the switch carrier has a substantially fixed position laterally of the screen. On the opposite side of the screen (the ridge side in FIG. 13) the switch carrier is spring-biased laterally outward.

Figure 16:
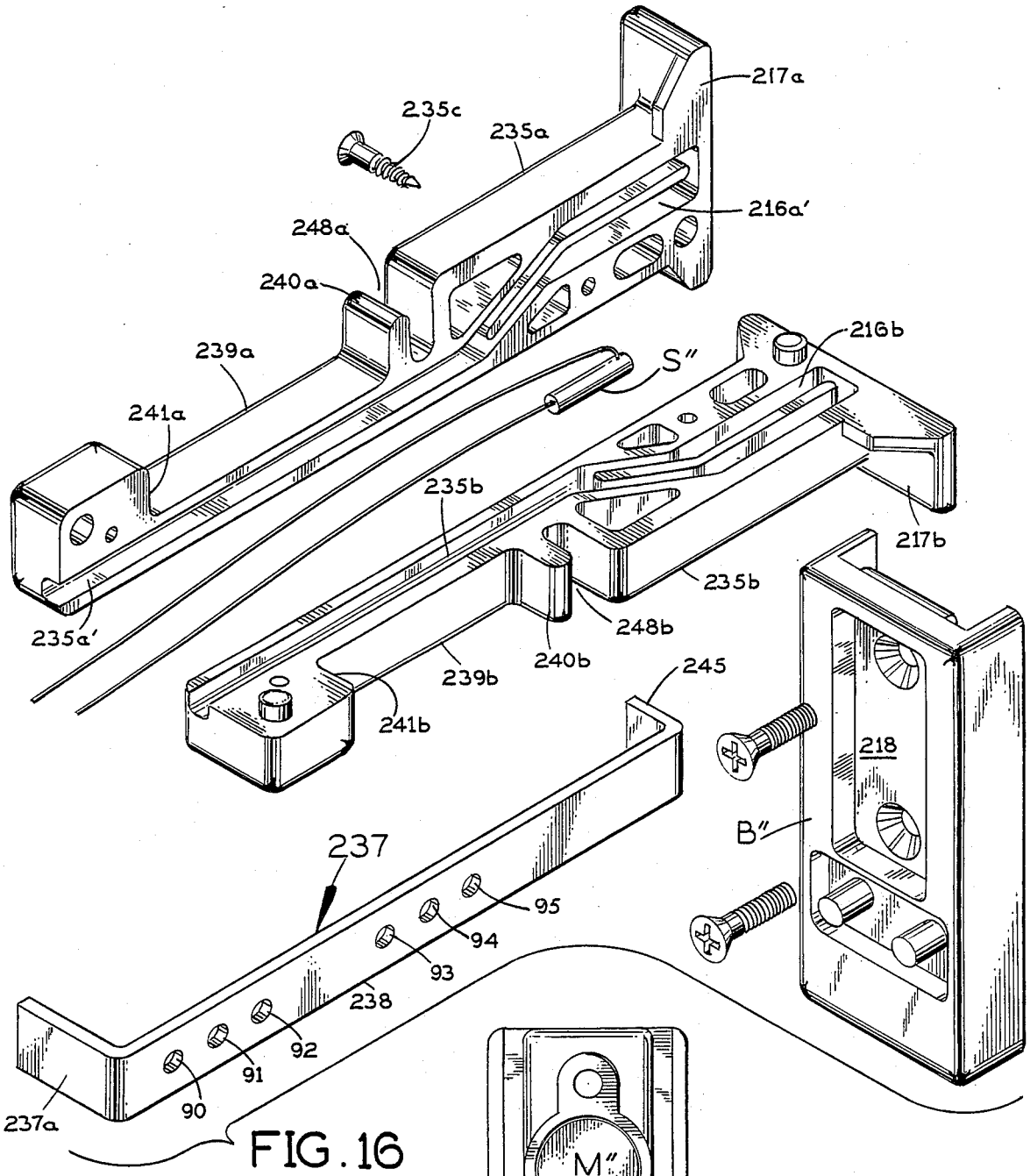
FIG. 16 is an exploded perspective view showing a mounting bracket, a retainer member, and a switch carrier at one of the four corners of the screen assembly in accordance with the third embodiment.
Figure 17:
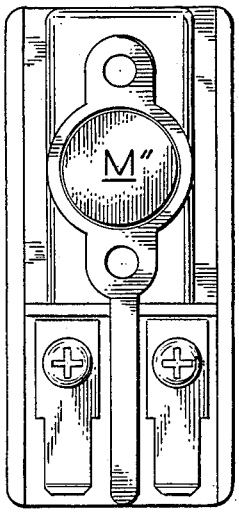
FIG. 17 is an elevational view of the laterally outward side of the mounting bracket in FIG. 16.

As shown in FIG. 14, each switch carrier has two rigid, molded plastic bodies **235*a* and 235*b* held together by screws 235*c* to provide a unitary structure. As shown in FIG. 16, the switch carrier bodies are formed on their abutting inner sides with longitudinal grooves 235*a*′ and 235*b*′ leading to respective recesses 216*a* and 216*b* slidably receiving the magnetically-operated reed switch S″. The grooves 235*a*′ and 235*b*′ and the recesses 216*a* and 216*b* register with each other when the switch carrier bodies 235*a* and 235*b* are together. The electrical wiring 213 for the reed switch is received in grooves 235*a*′ and 235*b*′**.

When the two halves of the switch carrier are attached to each other they define on the outside (FIG. 13):

- a narrow slot 248 which is open along this edge of the switch carrier away from the screen;
- an elongated recess 239 which is open along this edge of the switch carrier and is located on the opposite side of slot 248 from the reed switch S″; and
- a solid segment 240 between recess 239 and slot 248.

The opposite end of recess 239 from segment 240 is defined by an internal flat surface 241 of the switch carrier. The corresponding features of the switch carrier are designated in FIG. 16 with the same reference numerals, with "a" and "b" suffixes added.

Figure 13:
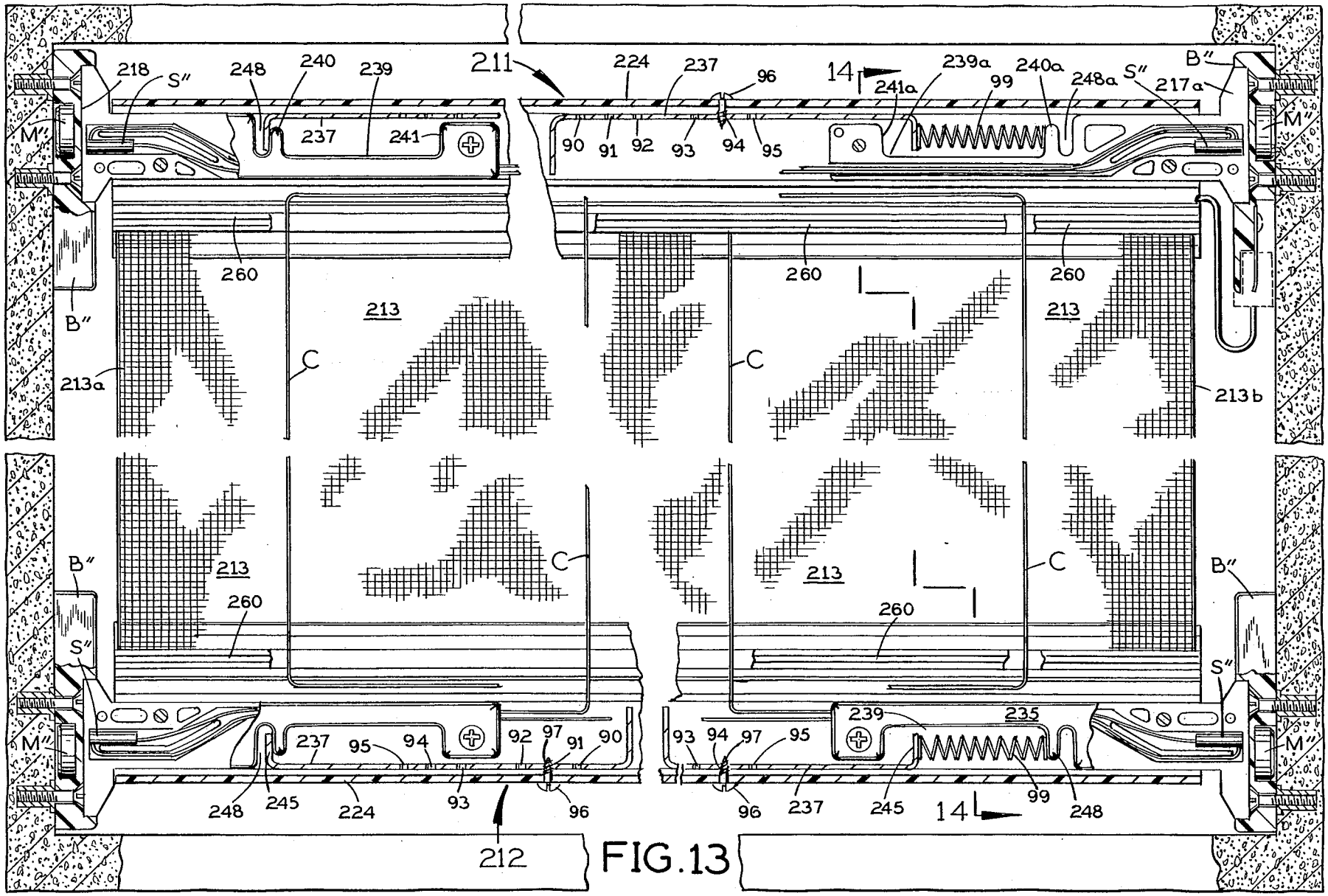
FIG. 13 is a view similar to FIG. 6 and showing a third embodiment of this invention.

At the laterally outward end of the switch carrier, the respective halves of the switch carrier present enlarged segments **217*a* and 217*b*, each of which extends above and below and past the outer face of that switch carrier body 235*a* or 235*b*. When the switch carrier is assembled, these enlarged end segments have a snug slidable fit in a rectangular recess 218 in the corresponding mounting bracket B″. As shown in FIG. 13**, the bottom wall of this recess is relatively thin. The magnet M″ on the bracket is on the opposite side of this bottom wall.

Except for its enlarged laterally outward end segment **217*a*, 217*b*, each switch carrier 235 has a snug sliding fit in the longitudinal recess at that end of the end rail, which recess is defined by segments 234,239,228*a* and 223 of the end rail, as shown in FIG. 14**.

Also received in this longitudinal recess in the end rail and associated with a corresponding switch carrier 235 is a rigid retainer member 237 as shown in FIG. 16. The retainer member has an elongated, flat, longitudinal leg 238, a transverse leg 245 at one end extending perpendicular to its longitudinal leg, and a longer transverse leg **237*a* at the opposite end of its longitudinal leg. The longitudinal leg has a first set of three longitudinally spaced openings 90,91 and 92 located near its transverse end leg 237*a* and a second set of three longitudinally spaced openings 93,94 and 95 located nearer its opposite transverse end leg 245**.

In each end rail the bridging wall 224 of its outer piece 221 extends horizontally along the outside (top or bottom) of the screen assembly. This bridging wall is formed with two longitudinally spaced openings 96, as shown at the bottom of FIG. 13 (only one opening 26 being visible at the top because of the location of the break line). Each opening 96 in the end rail receives a sheet metal screw 97, which is threadedly receivable in a corresponding opening 90,91,92,93,94 or 95 in the corresponding retainer member 237.

As shown in FIG. 13, at the left side of the screen the middle hole 91 of each retainer member 237 (at the top and bottom) registers with the corresponding opening 96 in the end rail and threadedly receives the corresponding screw 97, which fastens this retainer member to the end rail. The transverse end leg 245 of this retainer member is received in the narrow slot 248 in the switch carrier 235. Consequently, this switch carrier is substantially fixedly mounted in the end rail, with just a limited amount of longitudinal "play" due to the looseness of the fit of retainer member leg 245 in switch carrier slot 248.

To have the switch carrier 235 extend a greater or a lesser amount laterally beyond the end rail at this side of the screen, the opening 92 or the opening 90 in retainer member 237 may register with the corresponding end rail opening 96 and receive the corresponding screw 97.

At the right side of the screen, top and bottom, each retainer member 237 has the opposite orientation with respect to the switch carrier 235 as on the left side.

As shown in FIG. 13, on this side the middle opening 94 of the second set of openings 93–95 in retainer member 237 registers with the corresponding opening 96 in the end rail and threadedly receives the corresponding screw 97, so that the retainer member is rigidly affixed to the end rail. The transverse end segment 245 of the retainer member extends into the elongated recess 239 in the switch carrier. A coil spring 99 is located in this recess in the switch carrier, engaged under compression between the transverse leg 245 of the switch carrier and the solid segment 240 of the switch carrier. This spring biases the switch carrier laterally outward along the end rail of the screen assembly, so that the enlarged end of the switch carrier is received with a sufficiently tight fit in the mounting bracket recess 218.

Instead of the middle opening 94, either of the other openings 93 or 95 of the second set of openings in retainer member 237 may be selected to register with the corresponding opening 96 in the end rail and receive the corresponding screw, thereby adjusting the extent to which the spring-biased switch carrier 235 projects laterally beyond the end rail before being inserted in the corresponding mounting bracket.

The mode of installation of this third embodiment of the present screen assembly is substantially the same as for the first embodiment.

While the drawings show this screen assembly on the inside of a window, it could be on the outside, if desired.

Also, the present screen assembly could be used at an access opening in a building other than at a window. For example, it could be used at a doorway, particularly one where a horizontally sliding door is located.

We claim:

1. A roll-up intrusion alarm screen assembly comprising:

two substantially rigid opposite end piece assemblies;

a screen attached to and extending between said opposite end piece assemblies, said screen having opposite side edges, each extending between said opposite end piece assemblies, said screen being flexible throughout its extent between said end piece assemblies so that it can be rolled up around either of said end piece assemblies;

electrical wiring in said screen providing a continuous uninterrupted circuit between said end piece assemblies and entirely within said screen laterally inward from said opposite side edges of the screen;

respective holding means for supporting the opposite ends of said end piece assemblies to position said screen covering an access opening of premises to be protected;

and circuit closing means acting only between each said holding means and the corresponding end of a respective end piece assembly for closing said circuit through said wiring in the screen when that end of the end piece assembly is held by said holding means and for opening said circuit when that end of the end piece assembly is removed from said holding means.

2. An intrusion alarm screen assembly according to claim 1 wherein each said holding means is a mounting bracket adapted to be mounted in a corner of said access opening and presenting a recess for receiving the corresponding end of the respective end piece assembly.

3. An intrusion alarm screen assembly according to claim 2 wherein said circuit closing means comprises manually attachable and separable electrical plug and socket members on said bracket and the corresponding end of the respective end piece assembly, said plug and socket members fitting together to complete the circuit through said wiring in the screen when said end of the end piece assembly is seated in said recess in the bracket.

4. An intrusion alarm screen assembly according to claim 3 wherein said opposite side edges of said screen are continuous, straight, uninterrupted and flexible throughout the length of each between said end piece assemblies, said side edges being free of projecting inflexible elements.

5. An intrusion alarm screen assembly according to claim 2 wherein said circuit closing means comprises a magnet on the mounting bracket and a normally-open magnetically-operated switch on the respective end piece assembly.

6. An intrusion alarm screen assembly according to claim 5 wherein each of said end piece assemblies has a switch carrier at one end thereof and spring means biasing said switch carrier outward along said end piece assembly, said switch carrier being retractable inward along said end piece assembly against the force of said spring means for snap-in insertion into the corresponding mounting bracket, said switch carrier holding a corresponding magnetically-operated switch.

7. An intrusion alarm screen assembly according to claim 6 wherein each of said end piece assemblies has a switch carrier at its opposite end and means fixedly positioning said last-mentioned switch carrier along said end piece assembly, said last-mentioned switch carrier holding a corresponding magnetically-operated switch.

8. An intrusion alarm screen assembly according to claim 7 wherein said opposite side edges of said screen are continuous, straight, uninterrupted and flexible throughout the length of each between said end piece assemblies, said side edges being free of projecting inflexible elements.

9. A roll-up intrusion alarm screen assembly comprising:

two substantially rigid opposite end piece assemblies;

a screen attached to and extending between said opposite end piece assemblies, said screen being flexible throughout its extent between said end piece assemblies so that it can be rolled up around either of said end piece assemblies, said screen presenting continuous, straight, uninterrupted, opposite edges between said end piece assemblies, said edges being free of projecting electrical terminals;

electrical wiring in said screen providing a continuous uninterrupted circuit between said end piece assemblies and entirely within said screen;

respective holding means for supporting the opposite ends of said end piece assemblies to position said screen covering an access opening of premises to be protected, each said holding means being a mounting bracket adapted to be mounted in a corner of said access opening and presenting a recess for receiving the corresponding end of the respective end piece assembly;

and circuit closing means acting between each said mounting bracket and the corresponding end of a respective end piece assembly for closing said circuit through said wiring in the screen when that end of the end piece assembly is held by the corresponding mounting bracket and for opening said circuit when that end of the end piece assembly is removed from said mounting bracket, each said circuit closing means comprising a magnet on the mounting bracket and a normally-open magnetically-operated switch on the respective end piece assembly;

each of said end piece assemblies having a switch carrier at one end thereof and spring means biasing said switch carrier outward along said end piece assembly, said switch carrier being retractable inward along said end piece assembly against the force of said spring means for snap-in insertion into the corresponding mounting bracket, said switch carrier holding a corresponding magnetically-operated switch;

each of said end piece assemblies having a switch carrier at its opposite end and means fixedly positioning said last-mentioned switch carrier along said end piece assembly, said last-mentioned switch carrier holding a corresponding magnetically-operated switch;

each of said end piece assemblies comprising:

an elongated end rail extending across substantially the full extent of the screen between the mounting brackets at that end of the screen and defining respective first and second longitudinal recesses respectively in its opposite ends, and first and second retainer members attached to said end rail and received respectively in said first and second recesses in the end rail, said first and second retainer members being substantially identical and interchangeable;

and said first and second switch carriers being substantially identical and interchangeable and coupled respectively to said first and second retainer members in said first and second recesses in the end rail.

10. A role-up intrusion alarm screen assembly comprising:

two substantially rigid opposite end piece assemblies;

a screen attached to and extending between said opposite end piece assemblies, said screen being flexible throughout its extent between said end piece assemblies so that it can be rolled up around either of said end piece assemblies, said screen presenting continuous, straight, uninterrupted, opposite edges between said end piece assemblies, said edges being free of projecting electrical terminals;

electrical wiring in said screen providing a continuous uninterrupted circuit between said end piece assemblies and entirely within said screen;

respective holding means for supporting the opposite ends of said end piece assemblies to position said screen covering an access opening of premises to be protected, each said holding means being a mounting bracket adapted to be mounted in a corner of said access opening and presenting a recess for receiving the corresponding end of the respective end piece assembly;

and circuit closing means action between each said mounting bracket and the corresponding end of a respective end piece assembly for closing said circuit through said wiring in the screen when that end of the end piece assembly is held by the corresponding mounting bracket and for opening said circuit when that end of the end piece assembly is removed from said mounting bracket, each said circuit closing means comprising a magnet on the mounting bracket and a normally-open magnetically-operated switch on the respective end piece assembly;

each of said end piece assemblies comprising:

a rigid elongated end rail extending across substantially the full extent of the screen between the mounting brackets at that end of the screen and defining respective first and second longitudinal recesses in its opposite ends;

a first rigid retainer member attached to said end rail and received in said first recess in said end rail, said first retainer member having a transverse leg projecting toward the screen;

a first switch carrier positioned in said first recess in the end rail between said first retainer member and the screen, said first switch carrier having a narrow slot therein which is open toward said first retainer member;

said transverse leg of the first retainer member extending into the narrow slot in the first switch carrier to hold said first switch carrier fixedly on said end rail with said first switch carrier projecting laterally outward beyond the adjacent end of said end rail and into the adjacent mounting bracket;

a second rigid retainer member attached to said end rail and received in said second recess in the end rail, said second retainer member having a transverse leg projecting toward the screen;

a second switch carrier positioned slidably in said second recess in the end rail between said second retainer member and the screen, said second switch carrier having an elongated recess therein which is open along its length toward said second retainer member, a solid segment at the laterally outward end of said recess toward the adjacent mounting bracket, and a narrow slot on the opposite side of said solid segment from said recess, said slot being open toward said second retainer member;

said transverse leg of the second retainer member extending into said recess in the second switch carrier at the laterally inward end of said recess in the second switch carrier away from the adjacent mounting bracket;

and a spring in said recess in the second switch carrier engaged under compression between said transverse leg of the second retainer member and said solid segment of the second switch carrier, whereby to resiliently bias the second switch carrier laterally outward past said end rail into the adjacent mounting bracket.

11. An intrusion alarm screen assembly according to claim 10 wherein:

said first and second retainer members are interchangeable and substantially identical;

and said first and second switch carriers are interchangeable and substantially identical.

12. An intrusion alarm screen assembly according to claim 10 and further comprising:

means for selectively adjusting the position of said first retainer member along said end rail.

13. An intrusion alarm screen assembly according to claim 10 and further comprising:

means for selectively adjusting the position of said second retainer member along said end rail.

14. An intrusion alarm screen assembly according to claim 10 and further comprising:

means for selectively adjusting the position of said second retainer member along said end rail, whereby to determine the compression of said spring by the engagement of said second switch carrier in the adjacent mounting bracket;

and means for selectively adjusting the position of said first retainer member along said end rail, whereby to determine how far said first switch carrier projects beyond said end rail.

15. An intrusion alarm screen assembly according to claim 14 wherein:

said first and second retainer members are interchangeable and substantially identical;

and said first and second switch carriers are interchangeable and substantially identical.

16. An intrusion alarm screen according to claim 15 wherein:

each of said retainer members has a longitudinal leg extending next to said end rail lengthwise of the end rail, said longitudinal leg having a first set of openings therein spaced apart lengthwise of said longitudinal leg laterally inward from said transverse leg of the retainer member, said longitudinal leg having a second set of longitudinally spaced openings therein located farther inward from said transverse leg than said first set of openings;

and said end rail has first and second openings therein located respectively toward its opposite ends;

said first retainer member has one of its first set of openings registering with said first opening in the end rail and receiving a first fastener member to attach said first retainer member to said end rail;

and said second retainer member has one of its second set of openings registering with said second opening in the end rail and receiving a second fastener member to attach said second retainer member to said end rail.

17. A roll-up intrusion alarm screen assembly comprising:

two substantially rigid opposite end piece assemblies;

a screen attached to and extending between said opposite end piece assemblies, said screen being flexible throughout its extent between said end piece assemblies so that it can be rolled up around either of said end piece assemblies, said screen presenting continuous, straight, uninterrupted, opposite edges between said end piece assemblies, said edges being free of projecting electrical terminals;

electrical wiring in said screen providing a continuous uninterrupted circuit between said end piece assemblies and entirely within said screen;

respective holding means for supporting the opposite ends of said end piece assemblies to position said screen covering an access opening of premises to be protected, each said holding means being a mounting bracket adapted to be mounted in a corner of said access opening and presenting a recess for receiving the corresponding end of the respective end piece assembly;

and circuit closing means acting between each said mounting bracket and the corresponding end of a respective end piece assembly for closing said circuit through said wiring in the screen when that end of the end piece assembly is held by the corresponding mounting bracket and for opening said circuit when that end of the end piece assembly is removed from said mounting bracket, each said circuit closing means comprising a magnet on the mounting bracket and a normally-open magnetically-operated switch on the respective end piece assembly;

each of said end piece assemblies comprising:

an elongated end rail defining respective first and second longitudinal recesses in its opposite ends;

substantially identical and interchangeable first and second switch carriers slidably received respectively in said recesses and projecting longitudinally beyond the respective ends of said end rail;

a first retainer member mounted on said end rail in said first recess therein and holding said first switch carrier at a fixed position along said end rail;

a second retainer member substantially identical to and interchangeable with said first retainer member, said second retainer member being mounted on said end rail with the same orientation as said first retainer member with respect to said end rail but the opposite orientation with respect to said second switch carrier as the orientation of said first retainer member with respect to said first switch carrier;

and spring means acting between said second retainer member and said second switch carrier and biasing said second switch carrier outward along said end rail, said second switch carrier being retractable inward for snap-in insertion into the corresponding mounting bracket;

said switch carriers each holding a respective magnetically-operated switch.

18. An intrusion alarm screen according to claim 17 wherein:

each of said switch carriers has a longitudinal recess which is open at the inner end of the switch carrier along said end rail and is open along the longitudinal edge of the switch carrier away from the screen;

each of said switch carriers has a narrow slot located between said longitudinal recess therein and the outer end of said switch carrier, said slot being open at said longitudinal edge of the switch carrier;

each of said retainer members has a longitudinal leg extending next to said longitudinal edge of the switch carrier and a transverse end leg extending toward the screen;

said first retainer member has its transverse end leg received snugly in said slot in the first switch carrier to hold said first switch carrier fixedly positioned along said end rail;

said second retainer member has its transverse end leg extending across said longitudinal recess in the second switch carrier at the inner end of the second switch carrier;

and said spring means is a coil spring engaged under compression in said longitudinal recess in the second switch carrier by said transverse end leg of the second retainer member.

19. An intrusion screen assembly according to claim 18 wherein:

each of said switch carriers has an additional longitudinal recess therein which is open along said longitudinal edge of the switch carrier and is located between said narrow slot and said longitudinal recess at the inner end of said switch carrier, said additional longitudinal recess having transverse stop shoulders at its opposite ends; and further comprising:

first and second stop pins on said end rail of the respective end piece assembly at the locations of said additional longitudinal recesses in said switch carriers, each of said stop pins extending through said longitudinal leg of the respective retainer member and into said additional longitudinal recess in the respective switch carrier.

20. An intrusion screen assembly according to claim 19 wherein:

said first retainer member has a plurality of openings therein closely spaced apart along its longitudinal leg and all registering with said additional longitudinal recess in the first switch carrier, each of said openings being selectively registrable with said stop pin to position the first retainer member at a corresponding position along said end rail.

* * * * *